United States Patent [19]

Dickerson

[11] Patent Number: 4,902,434

[45] Date of Patent: Feb. 20, 1990

[54] FABRIC TREATMENT

[75] Inventor: Lyndel D. Dickerson, Centerville, Ohio

[73] Assignee: The Drackett Company, Cincinnati, Ohio

[21] Appl. No.: 261,053

[22] Filed: Oct. 21, 1988

[51] Int. Cl.[4] ..... D06M 1/00

[52] U.S. Cl. ..... 252/8.6; 8/137

[58] Field of Search ..... 252/8.6; 8/137

[56] References Cited

U.S. PATENT DOCUMENTS

| | | | |
|---|---|---|---|
| 4,161,449 | 7/1979 | Smith et al. | 252/8.6 |
| 4,385,632 | 5/1983 | Odelhog | 604/360 |
| 4,395,347 | 7/1983 | McLaughlin et al. | 252/139 |
| 4,566,980 | 1/1986 | Smith | 252/8.6 |
| 4,637,820 | 1/1987 | Marini et al. | 8/129 |
| 4,675,014 | 6/1987 | Sustmann et al. | 604/375 |
| 4,740,366 | 4/1988 | Winston et al. | 424/45 |
| 4,757,099 | 7/1988 | Hoshino et al. | 252/174.11 |

*Primary Examiner*—A. Lionel Clingman

*Attorney, Agent, or Firm*—Sandra M. Nolan

[57] ABSTRACT

The neutralization of odors and removal of soil from fibrous surfaces, e.g., carpets, can be carried out using fabric treatment compositions containing certain combinations of metal salts and carriers.

18 Claims, No Drawings

FABRIC TREATMENT

BACKGROUND

The treatment of fibrous material, especially carpets, made up of natural and/or synthetic polymeric fibers, to render them odor and dirt-resistant involves the use of a variety of chemical agents. Due to the likelihood of dirt and odor deposition on floor coverings, the problem is exacerbated by the fact that treating agents used to combat such problems are likely to come into contact with human beings and animals on a regular basis. The task becomes one of finding agents which will assist in the elimination of odors and soils, but which will not prove harmful if used in the proximity of people or animals.

Several attempts have been made to balance these considerations, i.e., efficiency in soil- and malodor-elimination versus safety in ecological terms.

Smith, et al., in U.S. Pat. No. 4,161,449, describe carpet treating compositions which contain inorganic carriers such as sodium bicarbonate, an agglomerating agent such as silicon dioxide, a perfume, and an antistatic agent.

In U.S. Pat. No. 4,566,980, Smith discloses a carpet treating composition containing coated carrier particles. The coating comprises a polymeric coating and a wax. Conventional additives, such as agglomerating agents, anti-static agents, and the like are disclosed.

U.S. Pat. No. 4,395,347 to McLaughlin, et al. deals with a borax carrier and a cleaning system which employs an ether alcohol solvent and a surfactant. Conventional additives are taught as optional.

Odelhog's U.S. Pat. No. 4,385,632 teaches germicidal absorbent bodies, e.g., diapers, towels, and the like, which contain water-soluble copper salts, e.g., copper chloride, copper acetate, etc., as impregnants for the fibers or wadding of the bodies. The bodies contain at least 150 micrograms copper per milliliter of liquid to be absorbed.

Sustmann, et al. (U.S. Pat. No. 4,675,014) and Marini, et al. (U.S. Pat. No. 4,637,820 disclose hygienic cellulosic devices, e.g., tampons and diapers, in which the cellulosic fibers have been chemically modified to incorporate cupric cations and certain anionics. The fibers contain 0.1–3% by weight copper, based on the weight of the fibers.

Winston, et al. (U.S. Pat. No. 4,740,366) describes an aerosol room deodorizer which contains a solution of an alkali metal salt and a fragrance.

Hoshino, et al. in U.S. Pat. No. 4,757,099, disclose deodorizing compositions which contain a combination of a zinc compound with an aliphatic polycarboxylic acid or salt on a thermo-plastic resin substrate.

The disclosures of these patents are hereby incorporated by reference.

THE INVENTION

Applicants have discovered that they can produce a readily-dispensible granular composition which has deodorizing effects, and is believed to have antibacterial or sanitizing effects as well, when deposited upon carpets, draperies, bedspreads, upholstery and other fabric or fabric-like substances.

The use of a dry state composition containing very small amounts of metal salts to achieve odor elimination is believed to be new in the art.

In a preferred embodiment, a composition containing 99% or more sodium bicarbonate carrier particles coated or mixed with 0.22% cupric chloride or other transition metal salt in the dry state is employed to substantially eliminate carpet odors. Minor amounts of surfactants, flow-control agents, agglomerating agents, dedusting agents and the like are employed.

Advantages

The compositions of the invention have several advantages over the treating compositions of the prior art.

They are highly effective in the reduction or elimination of unpleasant odors. In addition, the large reactive surface area of the metal salts promotes high chemical efficacy.

On the other hand, the compositions of the invention contain only minor amounts, e.g., 0.01 to 2%, of active metal ingredients, and those ingredients are not in solution. The small amount of actives means that the likelihood of toxicity problems is diminished. Accordingly, the environmental hazards associated with their use are minimized.

The high ratio of carrier to metal unexpectedly yields maximum efficiency as a physical and/or chemical absorbent of odors. In addition, the use of a dry transition metal complex or salt in a very thin outer coating on a carrier enables the small quantities of metal used to react as though they are present in larger amounts and makes the product easier to use.

Lastly, the compositions of the invention require the use of no perfume. Thus, they are true deodorizers since they do not rely on a perfume's fragrance to combat the unpleasant odor to be minimized.

These and other advantages will be better understood after consideration of the description of the invention which follows.

DESCRIPTION OF THE INVENTION

The invention is concerned with a treating compositions and processes of making and using same.

The compositions of the invention contain, as major components, the following ingredients in the ranges set forth.

| | Weight Percentages | | |
|---|---|---|---|
| Ingredient | Broad | Preferred | Highly Preferred |
| Transition Metal Compound* | 0.01–2 | 0.1–1 | 0.1–0.5 |
| Other adjuvants | 0–24.98 | 0.1–20 | 0.5–15 |
| Carrier | q.s–100 | q.s–100 | q.s–100 |

*The concentration of metal ion in the compounds should be about 0.1% to about 0.5%, preferably about 0.1% to about 0.3%

The use of adjuvants in the compositions of the invention is optional. The types of adjuvants contemplated are discussed below.

Unless stated otherwise, all percentages expressed herein are weight percentage, based on total composition weight.

Transition Metal Compounds

The compositions of the invention contain, as essential ingredients, at least one ionizable transition metal compound and at least one carrier. Effective combinations of same neutralize odors.

The transition metal compounds useful herein include the organic or inorganic salts of divalent transition metals. Preferred cations are copper, iron, zinc and the like.

Copper and zinc are highly preferred. Mixtures are operable.

Among the useful anionic moieties are anions whose divalent metal salts are substantially miscible with water or other solvent(s) which may be used to produce solutions to be sprayed upon the carrier(s). Preferred anions are chloride, nitrate, acetate, citrate, sulfate, phosphate, carbonate and the like. The chloride, citrate, acetate, and nitrate ions are highly preferred. Chloride is most preferred. Mixtures are operable.

While it is generally preferred that salts that dissociate in water are used, the use of coordination compounds is contemplated. Thus complex salts, such as disodium copper (II) citrate, zinc (II) ricinoleate, and the like, which may not appreciably dissociate to the hydrated metal ion in solution may be used. Mixtures are operable.

It is believed that the effectiveness of the compositions of the invention is due in part to the formation of coordination complexes when malodorous materials contact the transition metal salts on the surface of the carrier. Thus, the malodor becomes bound to the surface of the carrier, and can then be removed along with the carrier.

It is not required that either the metal salt or the carrier be in solution for the system of the invention to be operable. For reasons not yet fully understood, the use of very small quantities of metal salts and/or complexes in a solid, i.e., essentially dry, state yields highly effective rug and room deodorizers.

Carriers

The carriers of the invention are generally solid materials having particle sizes of between about 0.09 mm and about 0.25 mm, preferably about 0.1 mm to about 0.25 mm in average diameter. Stated differently, the surface area of the carrier particle should be such that the useful surface area of the final treating compositions will be about 24 to about 45 $cm^2/g$., and preferably about 24 to about 32 $cm^2/g$.

Useful carriers include one or more inorganic alkali or alkaline earth metal compounds. Among the preferred cationics in the carriers are sodium, potassium, calcium, and magnesium. Sodium is highly preferred. Mixtures are operable.

The anionic portion of the carrier species can be any of a variety of moieties including complexes of such moieties. Generally, carbonates, bicarbonates, sulfates, chlorides, phosphates, borates, nitrates, and the like are used. Bicarbonates and mixtures of sulfates and bicarbonates are preferred.

Mixtures of sodium sulfate and sodium bicarbonate having sulfate/bicarbonate weight ratios of 1:5 to 5:1 are operable. Various mixtures of other salts are contemplated.

While using the term "carrier" , applicants note that the substrate, e.g., NaHCO3, is believed to contribute to the odor neutralizing effects achieved. The bicarbonates and bicarbonate/sulfate combinations are thought to contribute to acid-base reactions in which some malodorous components participate.

Other Adjuvants

The other ingredients used in the compositions of the invention include a wide variety of conventional excipients and functional materials. In general, any substances, ingredients or combinations of same which are conventionally added to cleaning or deodorizing compositions may be added in suitable quantities so long as their presence in the compositions does not significantly alter the effectiveness of the two essential ingredients.

Useful adjuvants include, but are not limited to: flow control agents, surfactants, dedusting agents, agglomerators, fragrances, colorants, stabilizers, cleansers, fillers, anti-static agents, absorbents, and the like. Mixtures are operable.

As flow control agents, applicants contemplate the use of about 0 to about 3%, preferably 0.4–2%, of precipitated silica (e.g., colloidal silica), aluminas, magnesias, clays, talcs, cornstarch, and the like. U.S. Pat. No. 4,161,449 and others discussed above recite lists of such agents. Mixtures are operable.

Surfactants, when used, can be any of a wide variety of materials. Preferred surfactants are anionic ones. Highly preferred are sodium lauryl sulfate, magnesium lauryl sulfate, and the like. Quantities range from about 0.2 to about 0.8 wt. %, based on the total weight of the composition.

Other conventional additives which would assist the two essential ingredients can also be used in the compositions of the invention. Generally, however, they would only be present in minor amounts, e.g., about 0–20wt. %, and would merely enhance the beneficial properties of the principal components.

Preparation

The compositions of the invention are preferably provided as coated granules.

Coating the carrier material with the active ingredient is the preferred method of producing compounds having enhanced activity. Simple admixing does not generally produce the same results.

Typically, particles of the carrier, e.g., $NaHCO_3$ or a 50:50 $NaSO_4/NaHSO_4$ mixture, whose major particle size distribution is between about 0.01 and about 0.75 mm in diameter, preferably about 0.09 to about 0.25 mm in diameter are used. Mixing is achieved by tumbling in a conventional tumbling device. Typically, ribbon blenders, twin shell blenders, agitators, and the like, can be employed.

The deposition of the metal compound(s) onto the carrier can be effected by a variety of techniques. Two typical methods include:

A. The metal-containing solution is sprayed onto the carrier material and allowed to dry (e.g., in an oven at about 90° F.); or B. The metal-containing solution is sprayed onto the carrier, leaving the carrier wet, followed by the addition of precipitated silica or other moisture absorbent/flow enhancer.

When the metal-ion-containing material is sprayed onto the carrier, a useful device is an atomizer. One useful device is a sprayer from General Glassblowing of Richmond, Calif. (#CS50).

Once the carrier particles are at least partially coated, the treated particles can be dried and used as is. Preferably, however, a drying agent such as a silica is added to help absorb excess water introduced with the metal compound. Other additives, such as surfactants, perfumes, etc. can be added along with, or after, the drying agent.

When sodium sulfate or another inert material is used alone as the carrier, the coating technique should be such that the particles are substantially completely coated during the spraying operation.

Surfaces

The compositions and methods of the invention can be used to treat a variety of surfaces. Generally, they will be used on fabrics (woven or nonwoven) and carpeting. The compositions are formulated such that they penetrate between and rest upon fibers and can still be readily removed via vacuuming, brushing, dusting and the like.

The following examples illustrate the invention:

EXAMPLES

EXAMPLE I (Preparation)

The following is a description of a typical scheme for the production of compositions based upon the invention.

Description of Laboratory Scale Mixing Device

The mixing device consists of a polypropylene bucket (approximately ten inches in diameter and twelve inches deep) with four one-half inch "Lexan" fins that run inside the bucket from the bottom of the container up to within one inch of the top. Fixed to the outside bottom of the bucket is a shaft that allows the bucket to be connected to a motor so it can be rotated. The bucket is typically connected to a variable speed motor and operated at a 30°-45° angle from horizontal and at speeds of 20-80 r.p.m.

Preparation of Copper Chloride Treated Bicarbonate

Seven hundred and ninety grams of bicarbonate #5 (Church & Dwight of Princeton, N.J.) was placed in the mixing device described above and was tumbled at about 40 r.p.m. Using a chromatographic sprayer (General Glassblowing), 3.50 grams of a 50% solution of copper chloride was applied to the bicarbonate at a rate of about 2 grams per minute. This treatment produced an evenly colored light blue material, but also negatively affected the free flowing properties of the bicarbonate. Addition of 6.0 grams of a precipitated silica (Sylox 15 Davidson Chemical of Baltimore, Md.) followed by thorough mixing (2 to 3 minutes) restored the free flowing properties of the treated bicarbonate.

Preparation of a Rug & Room Deodorizer

Three hundred and forty (340) grams of bicarbonate #5 (Church & Dwight) and three hundred and forty (340) grams of sodium sulfate was placed in the laboratory scale mixing device and tumbled at a rate of about 30 r.p.m. Using the previously described technique, 3.50 grams of 50% copper chloride solution was sprayed onto the bicarbonate/sodium sulfate mixture. This was followed by the dropwise addition of 6.0 grams of a citrus type fragrance oil. Following fragrance addition, the mixture was allowed to mix for five minutes resulting in a damp granular mixture. While mixing, 3.5 grams of precipitated silica was added (Syloid 244-Davidson Chemical) resulting in a free flowing system.

Preparation of Zinc Chloride Treated Bicarbonate

Two hundred and ninety-seven 297) grams of sodium bicarbonate #5 (Church & Dwight) was placed in the previously described mixing device and tumbled at about 40 rpm. While mixing, 0.88 grams of 50% zinc chloride solution was sprayed onto the bicarbonate carrier over a one minute period. Subsequent addition of 2.0 grams of precipitated silica (Silox 15, Davidson Chemical), with mixing, produced a free flowing white formulation.

EXAMPLE II (Testing)

The following example describes tests of the effectiveness of the invention.

Efficacy Testing of Copper Salt Coated Carrier Materials

A synthetic malodor was prepared using the following formula:

| | |
|---|---|
| 4-methyl morpholine | 0.0600% |
| Hexanoic acid | 0.0600% |
| mercaptoacetic acid | 0.1100% |
| 2-naphthalene thiol | 0.0010% |
| skatole | 0.0010% |
| ethanol | 99.7680% |

Three identical 12 square inch nylon pile carpets were each treated with 0.55 (+0.03) grams of the synthetic malodor. The malodor was evenly sprayed via a fine mist onto an 8 inch square using a chromatographic spraying unit. The majority of the ethanol was allowed to evaporate by passing air over the surface of the carpet (approximately 60 linear feet per minute) for five minutes. One carpet sample received no further treatment, one was treated with 10.0 grams of bicarbonate, and the other treated with 10.0 grams of the copper chloride treated bicarbonate described above. Powdered treatments were applied by evenly sprinkling the material over the eight square inch area treated with the synthetic malodor. The samples were then placed into twelve cubic foot plexiglass boxes (2'×2'×3') fitted with a hinged door (1'×2')in the top of the box. After fifteen minutes of sample residence time, the samples were removed and panelists (10 minimum) were asked to smell the three boxes and evaluate the intensity of the malodor using magnitude estimation (Odor Quality and Chemical Structure, H. R. Moskowitz, C. B. Warren). The results were as follows:

TABLE I

| | Copper Chloride/ Sodium Bicarbonate Malodor Intensity* (0-no intensity) (160-extremely intense) |
|---|---|
| Malodor Only | 81 |
| Malodor + Bicarbonate | 79 |
| Malodor + Copper Chloride Treated Bicarbonate | 49 |

*Odor intensity was measured using olfactory magnitude estimation

After statistical treatment, it can be stated with 95% confidence that there is no difference between the intensity of the malodor in the boxes containing malodor only and malodor with bicarbonate. In addition, at a 95% confidence level, one can state that copper chloride treated bicarbonate significantly reduces the malodor level when compared to either the malodor only or malodor and bicarbonate box.

EXAMPLE III

The effectiveness of a zinc chloride/sodium bicarbonate system prepared in Example I was tested using the same malodor preparation and testing described in Example II. The results are shown in Table II.

TABLE II

| | Zinc Chloride/Sodium Bicarbonate Malodor Intensity (0–no intensity) (160–extremely intense) |
|---|---|
| Malodor Only | 111 |
| Malodor + Sodium Bicarbonate | 102 |
| Malodor + Zinc Chloride Treated Sodium Bicarbonate | 86 |

Again there was no statistically significant difference (95% confidence) between the intensity of the malodor treated sample and the sample treated with malodor and sodium bicarbonate. However, the zinc chloride treated sodium bicarbonate sample demonstrated a statistically significant reduction in malodor intensity (95% confidence) when compared with either of the other two samples.

Reasonable variations, such as those which would occur to a skilled artisan, can be made herein without departing from the scope of the invention.

I claim:

1. A dry composition useful for treating fibers comprising:

(a) 0.01–2% salt of at least one divalent transition metal compound;

(b) 0–10% of at least one conventional additive selected for the group consisting of agglomerating, fragrancing and processing agents; and (c) q.s. to 100% of at least one inorganic alkali or alkaline earth metal compoind as a carrier.

2. The compositions of claim 1 wherein (c) is sodium bicarbonate or a mixture of sodium bicarbonate and sodium sulfate.

3. The composition of claim 1 wherein (a) is a cupric salt.

4. The composition of claim 3 wherein (a) is cupric chloride.

5. The composition of claim 1 wherein (a) is a zinc salt.

6. The composition of claim 5 wherein (a) is zinc chloride.

7. A process for treating a fibrous surface comprising the steps of contacting that surface with a dry composition comprising:

(a) 0.01–2% of a salt of at least one divalent metal compound containing zinc or a transition metal;

(b) 0–10% of at least one conventional additive selected from the group consisting of agglomerating, fragrancing and processing agents; and (c) q.s to 100% of at least one inorganic alkali or alkaline earth metal compound as a carrier.

8. The process of claim 7 wherein (c) is sodium bicarbonate or a mixture of sodium bicarbonate and sodium sulfate.

9. The process of claim 8 wherein (a) is a cupric salt.

10. The process of claim 9 wherein (a) is cupric chloride.

11. The process of claim 8 wherein (a) is a zinc salt.

12. The process of claim 11 wherein (a) is zinc chloride.

13. A process for rendering fibrous surfaces odor resistant comprising the steps of:

(1) depositing a salt of at last one divalent metal compound containing zine or a transition metal onto particles of a carrier, which carrier is at least one inorganic alkali or alkaline earth metal compound;

(2) recovering the product of step (1); and (b 3) depositing a dry composition containing the product of step (2) upon a fibrous surface.

14. The process of claim 13 wherein the metal compound is a cupric salt.

15. The process of claim 14 wherein the carrier comprises at least one of sodium bicarbonate and sodium sulfate.

16. The process of claim 13 wherein the metal compound is a zinc salt.

17. The process of claim 16 wherein the carrier comprises at least one of sodium bicarbonate and sodium sulfate.

18. The process of claim 13 including the further step of adding at least one drying agent before the recovery step.

* * * * *

UNITED STATES PATENT AND TRADEMARK OFFICE

CERTIFICATE OF CORRECTION

PATENT NO. : 4,902,434

DATED : February 20, 1990

INVENTOR(S) : Lyndel D. Dickerson

It is certified that error appears in the above-identified patent and that said Letters Patent is hereby corrected as shown below:

Column 1, line 20, after "elimination", insert a comma, --,--.

Column 1, line 43, after 4,637,820, close the parentheses, ie., insert --)--.

Column 1, line 52, after "Hoshino, et al", insert a comma, --, --.

Column 2, line 58, read "percentage" as --percentages--.

Column 3, line 13, after "Thus", insert a comma --, --.

Column 3, line 57, read "NaHCO3" as --$NaHCO_3$--.

UNITED STATES PATENT AND TRADEMARK OFFICE

CERTIFICATE OF CORRECTION

PATENT NO. : 4,902,434

DATED : Feb. 20, 1990

INVENTOR(S) : Lyndel D. Dickerson

It is certified that error appears in the above-identified patent and that said Letters Patent is hereby corrected as shown below:

In the Claims

Claim 2, line 1 (col. 7 about line 35) read "compositions" as --composition--.

Claim 13, line 4, read "zine" as --zinc--.

Claim 13, line 8, read "(b 3)" as --(3)--.

Signed and Sealed this

Twenty-third Day of April, 1991

*Attest:*

*Attesting Officer*

HARRY F. MANBECK, JR.

*Commissioner of Patents and Trademarks*